US007299510B2

(12) United States Patent
Tsai

(10) Patent No.: US 7,299,510 B2
(45) Date of Patent: Nov. 27, 2007

(54) HOLDER DEVICE FOR SHOWER HEAD AND NOZZLE

(76) Inventor: Pi Kuang Tsai, 4F-3, No. 73, Sec. 1, Wensin Road, Nantun, Taichung 40878 (TW)

( * ) Notice: Subject to any disclaimer, the term of this patent is extended or adjusted under 35 U.S.C. 154(b) by 401 days.

(21) Appl. No.: 11/080,014

(22) Filed: Mar. 14, 2005

(65) Prior Publication Data

US 2006/0242759 A1 Nov. 2, 2006

(51) Int. Cl.
*A47K 3/28* (2006.01)

(52) U.S. Cl. ..... 4/601; 4/615; 239/283; 239/446

(58) Field of Classification Search ..... 4/567, 4/570, 601, 605, 615; 239/283, 446
See application file for complete search history.

(56) References Cited

U.S. PATENT DOCUMENTS

| | | | | |
|---|---|---|---|---|
| 2,216,149 | A | 10/1940 | Weiss | 4/615 X |
| 3,112,073 | A * | 11/1963 | Larson et al. | 239/446 |
| 3,979,096 | A * | 9/1976 | Zieger | 4/615 X |
| 4,461,439 | A | 7/1984 | Rose | 248/51 |
| 6,446,278 | B1 | 9/2002 | Lin | 4/615 |

* cited by examiner

*Primary Examiner*—Robert M. Fetsuga
(74) *Attorney, Agent, or Firm*—Charles E. Baxley

(57) ABSTRACT

A holder device may be attached to a water outlet tube which is extended from a wall, without drilling holes in the wall, and includes a housing having an inlet attached to the water outlet tube, and two or more outlet ports for attaching a shower head and a sprayer nozzle simultaneously. The housing includes an attaching device for attaching the sprayer nozzle to the housing. A controlling device may control the water to flow out through the outlet ports. The housing includes a casing having a chamber to receive a valve stem of the controlling device. The valve stem includes a passage for communicating the inlet with either or both of the outlet ports of the housing.

11 Claims, 6 Drawing Sheets

HOLDER DEVICE FOR SHOWER HEAD AND NOZZLE

BACKGROUND OF THE INVENTION

1. Field of the Invention

The present invention relates to a holder device and/or a control device, and more particularly to a holder and control device for supporting shower heads and shower nozzles, and for controlling the water to flow out through either or both of the shower heads and the nozzles.

2. Description of the Prior Art

Typical holder devices for supporting shower nozzles or other appliances comprise a bracket attached or secured to upper portions of supporting surfaces or walls or the like with fasteners. One or more holes should be drilled into the supporting surfaces or walls or the like with drilling machines or tools, for allowing the fasteners to be threaded into the supporting surfaces or walls or the like.

For example, U.S. Pat. No. 4,461,439 to Rose discloses one of the typical appliance holders including a wall mounted bracket which is required to be attached or secured to the supporting surfaces or walls or the like with fasteners, and one or more holes should also be drilled into the supporting surfaces or walls or the like for threading the fasteners.

However, many families have no drilling machines or tools, and may not easily drilling the holes into the supporting surfaces or walls or the like by themselves, such that the typical appliance holders may not be easily mounted by the users themselves.

U.S. Pat. No. 2,216,149 to Weiss discloses another typical appliance holder including a bracket attached or secured to the supporting surfaces or walls or the like with a suction cup, without drilling holes into the supporting surfaces or walls. However, the suction cups may easily move or slide relative to the supporting surfaces or walls due to the weight of the appliances or the shower nozzles or the like.

U.S. Pat. No. 6,446,278 to Lin discloses a further typical appliance holder including a bracket attached or secured to the supporting surfaces or walls or the like with a stronger sucker member, without drilling holes into the supporting surfaces or walls. However, similarly, after long term of using, the suction cups may also move or slide relative to the supporting surfaces or walls due to the weight of the appliances or the shower nozzles or the like, and due to the frequent attaching or disengaging of the shower nozzles to and from the bracket of the typical appliance holder.

In the typical appliance holders, a wall mounted bracket is further required to be provided and attached or secured to the supporting surfaces or walls or the like with fasteners or sucker members. The typical appliance holders may not be directly attached to the water outlet tube that is provided and extended from the supporting surfaces or walls.

The present invention has arisen to mitigate and/or obviate the afore-described disadvantages of the conventional holder devices.

SUMMARY OF THE INVENTION

The primary objective of the present invention is to provide a holder device directly attached to the water outlet tube that is provided and extended from the supporting surfaces or walls, for supporting shower heads and/or shower nozzles and the like.

The other objective of the present invention is to provide a holder device for readily attaching to the supporting surfaces or walls or the like without drilling holes in the supporting surfaces or walls or the like.

The further objective of the present invention is to provide a holder device for controlling the water to flow out through either or both of the shower heads and the nozzles.

In accordance with one aspect of the invention, there is provided a holder device for attaching to a water outlet tube which is typically extended from a wall and coupled to a water reservoir, the holder device comprising a housing including an inlet for attaching to the water outlet tube, and for receiving water from the water reservoir, the housing including a first outlet port and at least one second outlet port, and a controlling device for controlling the water to selectively flow out through either or both of the outlet ports.

For example, a shower head may further be provided and attached to the first outlet port of the housing, and a sprayer nozzle may further be provided and attached to the second outlet port of the housing. The controlling device may be used for controlling the water to flow out through either or both of the shower head and the sprayer nozzle.

The housing includes an attaching device attached thereto, for attaching the sprayer nozzle thereto. For example, the attaching device includes an opening formed therein for attaching the sprayer nozzle. The housing includes a partition secured thereto, the attaching device is rotatably attached to the partition. The partition includes a bore formed therein, a follower rotatably engaged in the bore of the partition secured to the attaching device.

The follower includes at least one key extended therefrom for keying and securing to the attaching device, and includes an enlarged head extended therefrom, for engaging with the partition, and thus for rotatably anchoring or securing the follower to the partition, and for preventing the follower from sliding relative to the partition.

The housing includes a casing received therein and having a chamber formed therein and communicating with the inlet and the first outlet port and the second outlet port of the housing. The controlling device includes a valve stem rotatably attached in the chamber of the casing, and having a passage formed therein, for communicating the inlet of the housing with the first outlet port and the second outlet port of the housing, to allow the water to selectively flow out through the first outlet port and the second outlet port of the housing.

The housing includes two valve seats formed in the casing and communicating with the first outlet port and the second outlet port of the housing respectively, the valve stem includes a compartment formed therein, and a spring-biased valve member received in the compartment of the valve stem, to engage with either of the valve seats of the housing, and to control the water to flow out through either or both of the first outlet port and the second outlet port of the housing.

A knob may further be provided and secured to the valve stem, to rotate the valve stem relative to the casing and the housing. The housing includes a spring-biased projection disposed therein, and engageable with the knob, to position the knob to the housing at selected position. The knob includes a barrel extended therefrom and attached to the valve stem, and at least one rib extended therein and coupled to the barrel, for reinforcing the barrel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
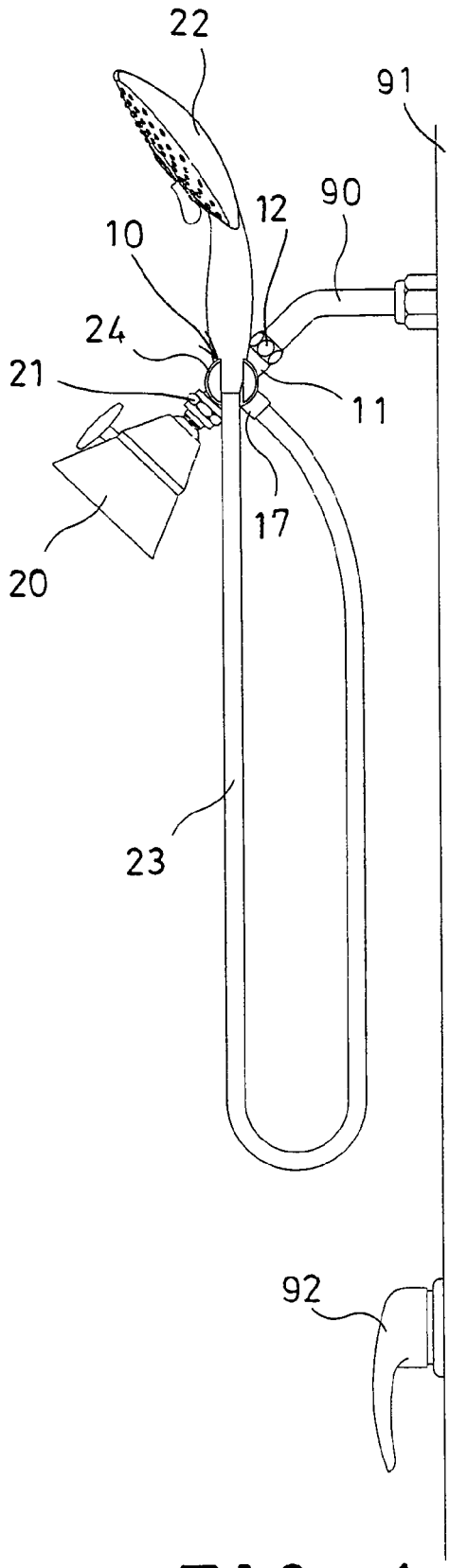
FIG. 1 is a side plan view of a holder device in accordance with the present invention.
Figure 2:
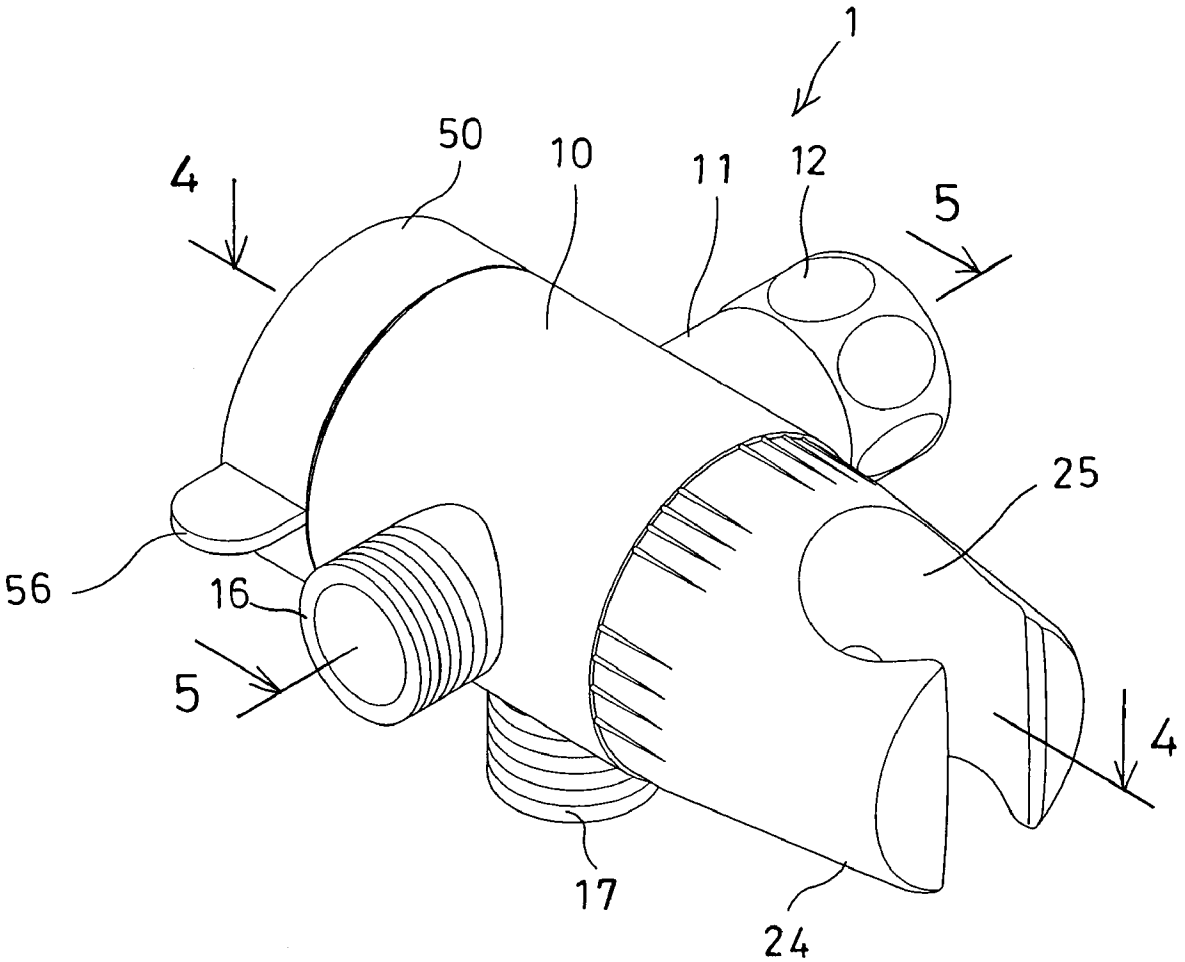
FIG. 2 is a perspective view of the holder device.

Referring to the drawings, and initially to FIGS. 1-5, a holder device 1 in accordance with the present invention comprises a housing 10 including an inlet 11 for attaching or securing to a water outlet tube 90 with one or more fasteners 12 and gaskets 13 or the like, and the water outlet tube 90 is normally or typically attached onto or extended from a wall or a supporting surface 91, and coupled to the typical or conventional water reservoirs for receiving water from the water reservoirs, and thus for supplying the water to the housing 10.

As shown in FIG. 1, a control device 92 is typically provided and also attached onto the wall or the supporting surface 91, and disposed below the water outlet tube 90, for controlling hot water and/or cold water to flow out through the water outlet tube 90. The above-described water outlet tube 90 and the control device 91 for attaching and controlling the holder device 1 are typical and will not be described in further details.

The housing 10 includes a casing 14 disposed therein and having a chamber 15 formed or provided therein and communicating with the inlet 11 thereof, for receiving the water from the water reservoirs, and further includes two or more outlet ports 16, 17 communicating with the chamber 15 of the casing 14, for allowing the water to flow out through either or both of the two outlet ports 16, 17 of the housing 10 (FIGS. 4-7).

A typical or conventional shower head 20 may further be provided and attached or secured to one of the two outlet ports 16, 17, such as the outlet port 16 of the housing 10 with one or more fasteners 21 and gaskets (not shown) or the like, as shown in FIG. 1, for allowing the water to selectively flow out through the typical or conventional shower head 20 via the outlet port 16 of the housing 10.

The other outlet port 17 of the housing 10 may be coupled or secured to a sprayer nozzle 22 via a hose 23 (FIG. 1), for example, for allowing the water to selectively flow out through the sprayer nozzle 22 via the other outlet port 17 of the housing 10. The holder device 1 further includes an attaching device 24 attached or secured to one side portion 18 of the housing 10, and having an engaging opening 25 formed therein for hooking or attaching the sprayer nozzle 22 thereto, also best shown in FIG. 1.

It is to be noted that the sprayer nozzle 22 may thus be easily and readily attached to the attaching device 24 which is attached or secured to one side portion 18 of the housing 10, and the housing 10 is directly attached or secured onto the water outlet tube 90, such that no holes are required to be drilled within the wall or the supporting surface 91, and thus no wall mounted brackets are required to be attached or secured to the supporting surfaces or walls or the like.

Figure 3:
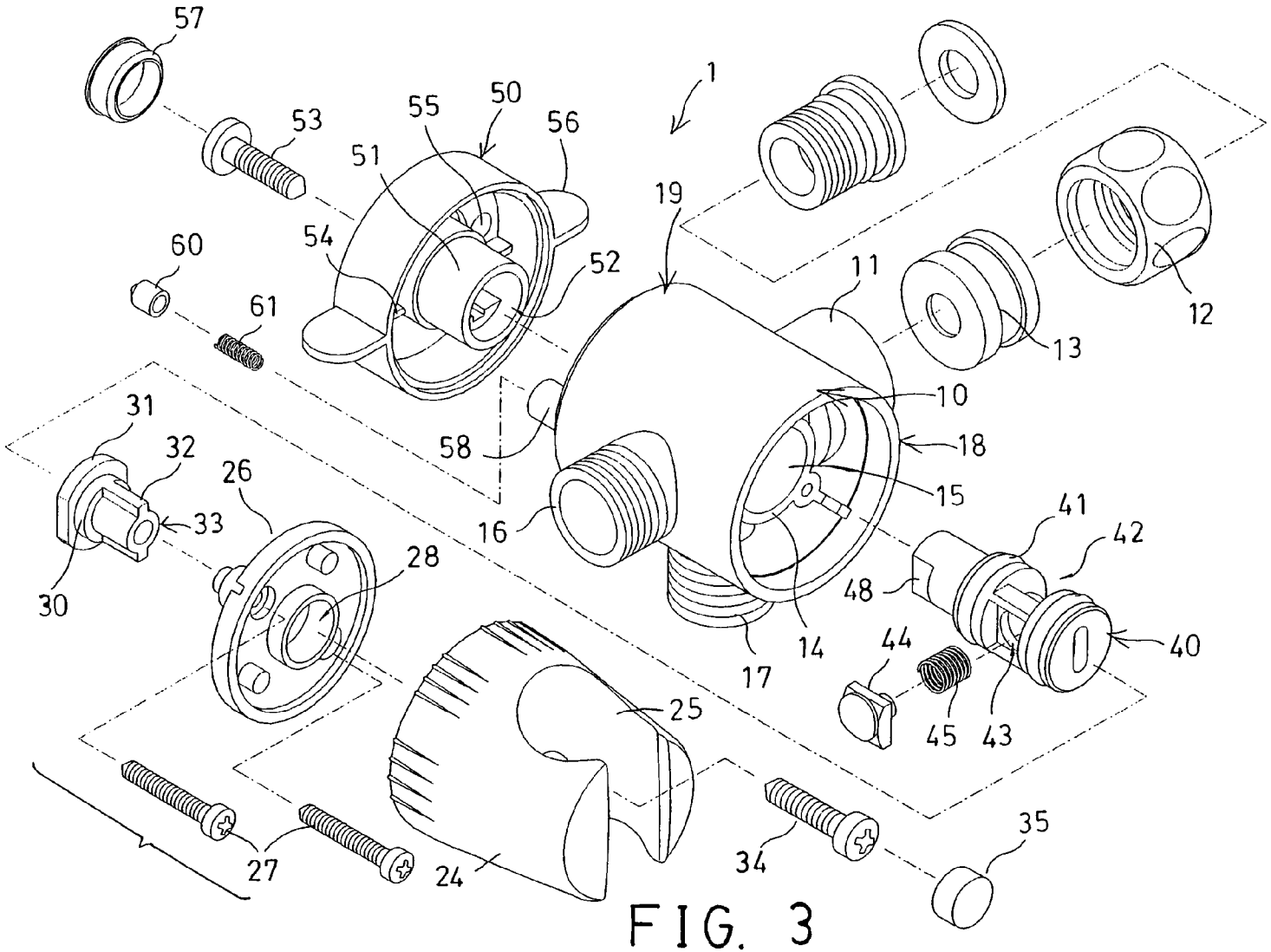
FIG. 3 is an exploded view of the holder device.
Figure 4:
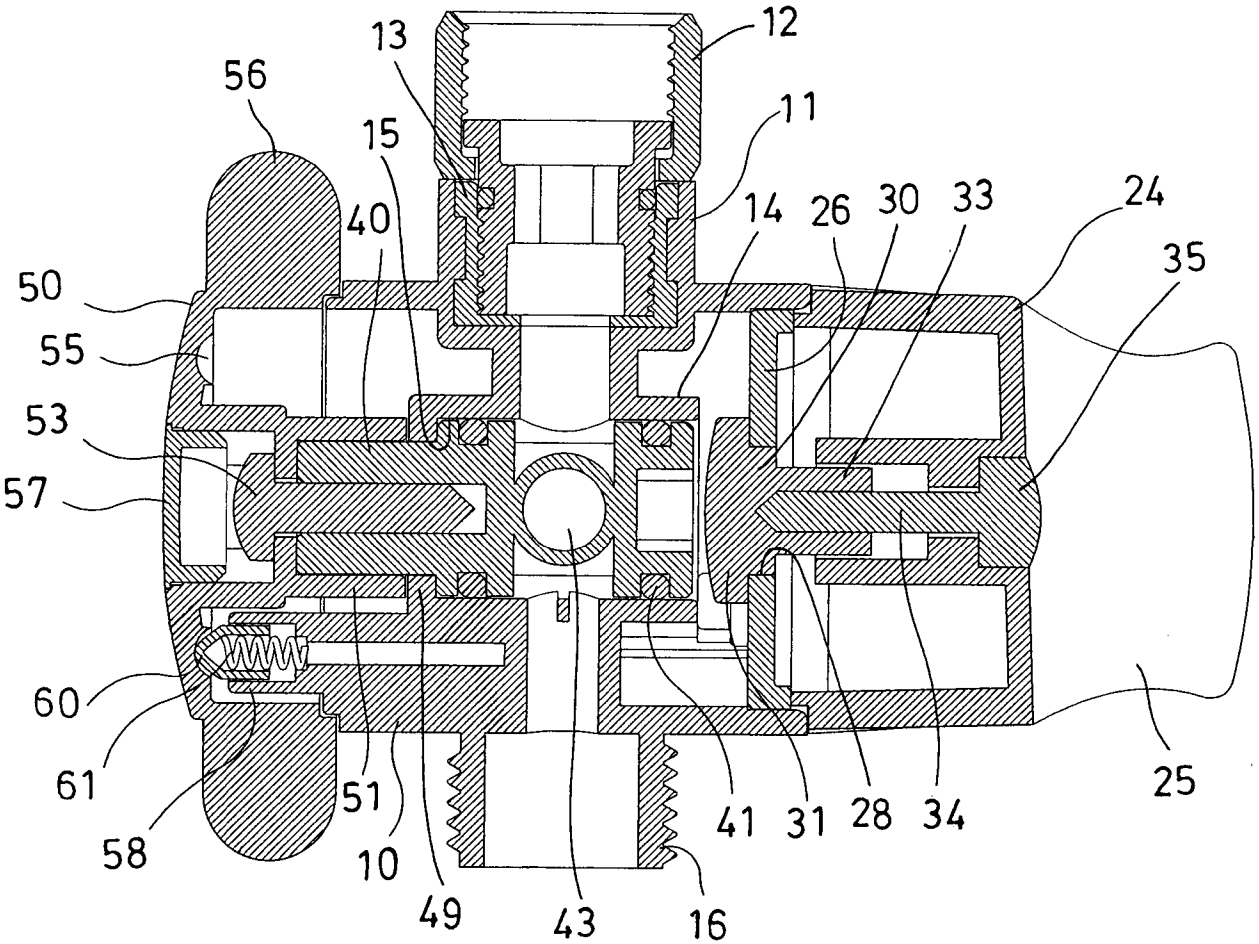
FIG. 4 is a partial cross sectional view of the holder device, taken along lines 4-4 of FIG. 2.

As shown in FIGS. 3 and 4, a partition 26 may be secured to the one side portion 18 of the housing 10 with one or more fasteners 27 and includes a bore 28 formed therein. A follower 30 is rotatably engaged or received within the bore 28 of the partition 26, and includes an enlarged head 31 extended therefrom, for engaging with the partition 26, and for rotatably anchoring the follower 30 to the partition 26, and thus for preventing the follower 30 from sliding laterally or longitudinally relative to the partition 26.

The follower 30 further includes one or more keys or ribs 32 extended from an outer end 33 thereof, for keying or engaging or securing to the attaching device 24, and thus for securing the attaching device 24 to the follower 30, and thus to allow the attaching device 24 to be rotated in concert with the follower 30. One or more fasteners 34 may further be provided and engaged with the attaching device 24, and secured to the outer end 33 of the follower 30, to further solidly secure the follower 30 to the attaching device 24. An end cap 35 may be attached onto the fastener 34, to enclose or to shield the fastener 34.

The holder device 1 further includes a valve stem 40 rotatably attached or received within the chamber 15 of the casing 14, or directly attached or received within the housing 10, and one or more sealing rings 41 attached or engaged onto the valve stem 40 and engaged with the casing 14 or the housing 10, and thus for making a water tight seal between the valve stem 40 and the casing 14 or the housing 10.

The valve stem 40 includes a passage 42 formed therein, for communicating the inlet 11 of the housing 10 with either or both of the outlet ports 16, 17 of the housing 10 (FIGS. 5-7), to allow the water to selectively flow out through either or both of the two outlet ports 16, 17 of the housing 10. The valve stem 40 includes a compartment 43 formed therein, for receiving a valve member 44 and a spring member 45 which may bias the valve member 44 to engage with either of two valve seats 46, 47 that are formed in the casing 14 or the housing 10, and that are communicating with the outlet ports 16, 17 of the housing 10 respectively.

Figure 5:
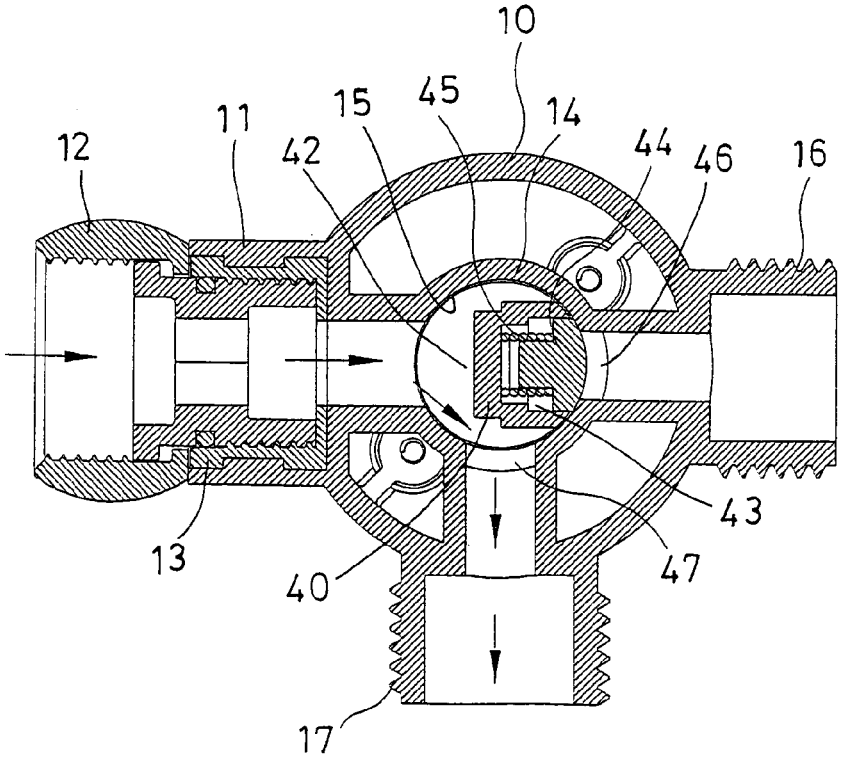
FIG. 5 is a partial cross sectional view of the holder device, taken along lines 5-5 of FIG. 2.

For example, as shown in FIG. 5, the spring member 45 may bias the valve member 44 to engage with the valve seat 46, and thus to block the outlet port 16 of the housing 10, and to prevent the water to flow out through the shower head 20 that is attached to the outlet port 16 of the housing 10, and arranged to allow the water to flow out through the sprayer nozzle 22 via the other outlet port 17 of the housing 10.

Figure 6:
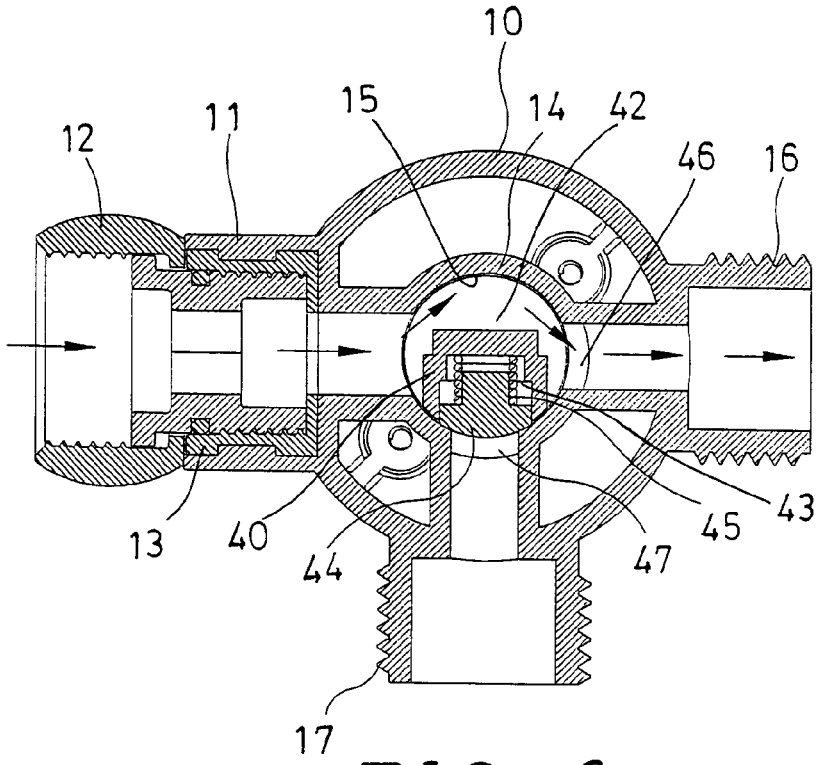
FIGS. 6, 7 are partial cross sectional views similar to FIG. 5, illustrating the operation of the holder device.

As shown in FIG. 6, the spring member 45 may also selectively bias the valve member 44 to engage with the other valve seat 47, and thus to block the other outlet port 17 of the housing 10, and to prevent the water to flow out through the sprayer nozzle 22 that is attached to the other outlet port 17 of the housing 10, and arranged to allow the water to flow out through the shower head 20 via the outlet port 16 of the housing 10.

Figure 7:
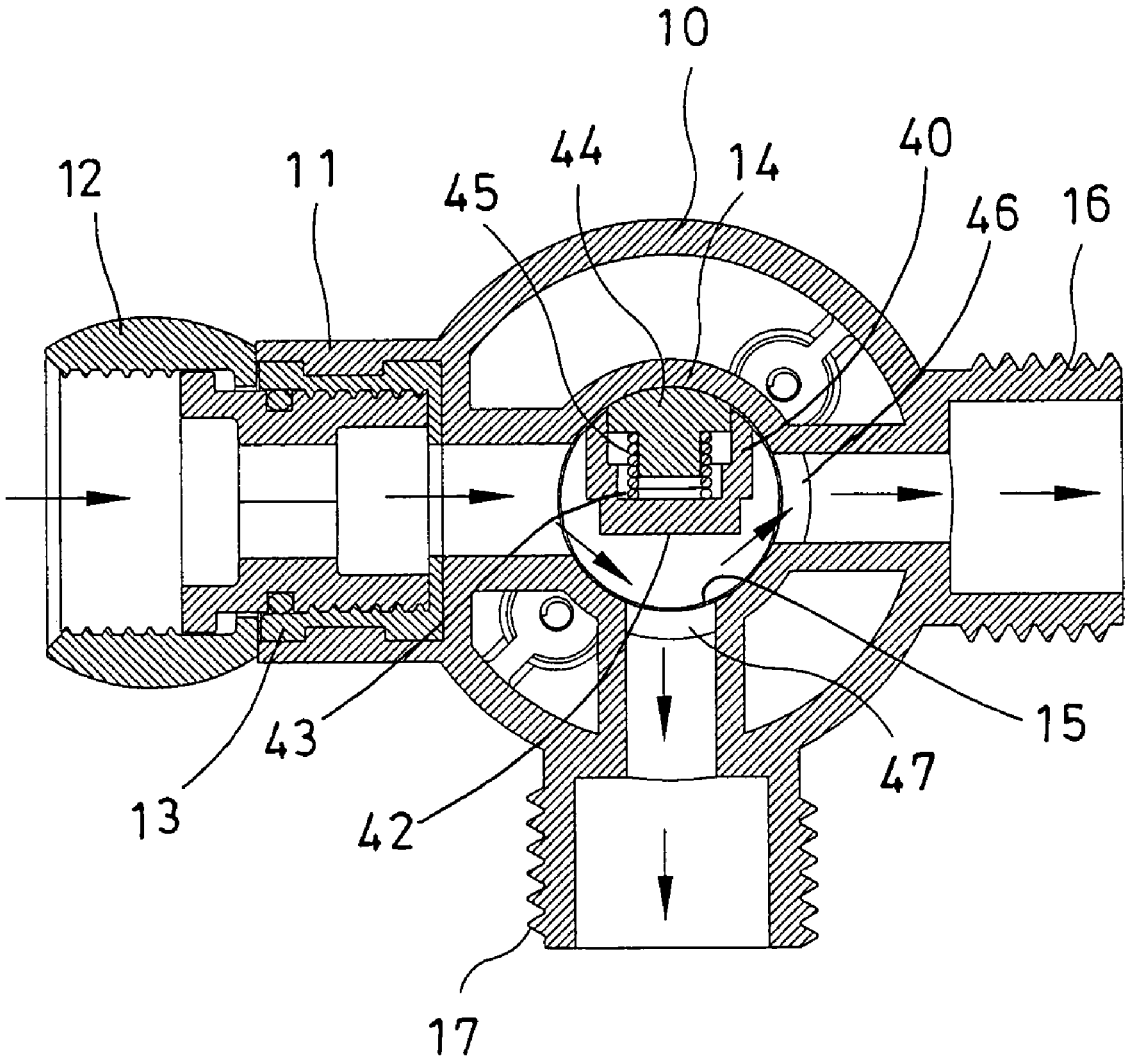

As shown in FIG. 7, alternatively, the valve member 44 may also be arranged to be disengaged from the valve seats 46, 47 of the casing 14 or of the housing 10, and thus to open the outlet ports 16, 17 of the housing 10, and thus to allow the water to flow out through the shower head 20 via the outlet port 16 of the housing 10 and to flow out through the sprayer nozzle 22 via the outlet port 17 of the housing 10. The valve stem 40 includes one end portion 48 (FIG. 3) for attaching or securing to a handgrip or knob 50 which may be used to rotate or to operate the valve stem 40 relative to the casing 14 or the housing 10.

The valve stem 40 may thus be used and acted as a controlling means or device for controlling the water to flow out through either or both of the shower head 20 and the sprayer nozzle 22. As shown in FIG. 4, the housing 10 may further include a peripheral stop 49 extended therein, such as extended into the chamber 15 of the casing 14, for engaging with the valve stem 40, and for rotatably anchoring the valve stem 40 to the casing 14 or the housing 10, and thus for preventing the valve stem 40 from sliding laterally or longitudinally relative to the casing 14 or the housing 10.

The knob 50 includes a barrel 51 extended therefrom and having a cavity 52 formed therein, for receiving the end portion 48 of the valve stem 40, which may further be solidly secured to the knob 50 with one or more fasteners 53, to solidly secure the valve stem 40 to the knob 50. It is preferable that the cavity 52 of the barrel 51 and the end portion 48 of the valve stem 40 each includes a non-circular cross section, to prevent the valve stem 40 from being rotated relative to the knob 50.

The knob 50 may further include one or more ribs 54 extended therein and coupled to the barrel 51, for reinforcing the barrel 51, and includes one or more, such as three depressions 55 formed therein, and includes one or more flaps 56 extended outwardly therefrom, for allowing the knob 50 and thus of the valve stem 40 to be easily rotated relative to the casing 14 or the housing 10 with the knob 50. A lid 57 may further be provided and attached onto the knob 50, to enclose or to shield the fastener 53.

The casing 14 or the housing 10 may further include a stud 58 extended therefrom, such as extended toward the knob 50, for receiving a projection 60 and a spring member 61 therein, in which the spring member 61 may bias the projection 60 to engage into either of the depressions 55 of the knob 50, to anchor or to position the knob 50 to the casing 14 or to the housing 10 at selected angular positions.

For example, when the projection 60 is biased by the spring member 61 to engage into one of the depressions 55 of the knob 50, the valve member 44 may be positioned and maintained in engagement with the valve seat 46 (FIG. 5), to block the outlet port 16 of the housing 10, and to prevent the water to flow out through the shower head 20, and to allow the water to flow out through the sprayer nozzle 22.

When the projection 60 is biased by the spring member 61 to engage into the other depression 55 of the knob 50, the valve member 44 may be positioned and maintained in engagement with the other valve seat 47 (FIG. 6), to block the other outlet port 17 of the housing 10, and to prevent the water to flow out through the sprayer nozzle 22, and to allow the water to flow out through the shower head 20.

When the projection 60 is biased by the spring member 61 to engage into the further depression 55 of the knob 50, the valve member 44 may be positioned and maintained in disengaging from the valve seats 46, 47 of the casing 14 or of the housing 10, to open the outlet ports 16, 17 of the housing 10, and to allow the water to flow out through the shower head 20 and the sprayer nozzle 22 via the outlet ports 16, 17 of the housing 10.

In operation, as shown in FIGS. 4-7, the valve stem 40 may be easily rotated relative to the casing 14 or the housing 10 with the knob 50, in order to control the water to flow out through either or both of the shower head 20 and the sprayer nozzle 22 via either or both of the outlet ports 16, 17 of the housing 10. In addition, both the shower head 20 and the sprayer nozzle 22 may be attached to the housing 10 that may be directly attached or secured to the water outlet tube 90, without drilling holes in the wall or the supporting surface 91. The attaching device 24 may optionally or selectively provided and attached or secured to the housing 10, for optionally or selectively hooking or attaching the sprayer nozzle 22 to the housing 10.

It is to be noted that the typical appliance holders may be used to support the shower head 20 only, but may not be used to attach or to secure a sprayer nozzle 22 thereto. It is further to be noted that no holes are required to be drilled into the supporting surfaces or walls 91 or the like, such that the holder device 1 may be easily attached onto the supporting surfaces or walls 91 or the like, and assembled or mounted by the users themselves.

Accordingly, the holder device in accordance with the present invention may be directly attached to the water outlet tube that is typically provided and extended from the supporting surfaces or walls, for supporting shower heads and/or shower nozzles and the like, without drilling holes in the supporting surfaces or walls or the like, and for controlling the water to flow out through either or both of the shower heads and the nozzles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder device for attaching to a water outlet tube which is typically extended from a wall and coupled to a water reservoir, said holder device comprising:

a housing including an inlet for attaching to the water outlet tube, and for receiving water from the water reservoir, said housing including a first outlet port and at least one second outlet port, and including a partition secured thereto, means for controlling the water to flow out through said first outlet port and said at least one second outlet port, a sprayer nozzle attached to said at least one second outlet port of said housing, an attaching device rotatably attached to said partition of said housing for attaching said sprayer nozzle, said partition including a bore formed therein, and a follower rotatably engaged in said bore of said partition and secured to said attaching device.

2. The holder device as claimed in claim 1, wherein said follower includes at least one key extended therefrom for keying and securing to said attaching device, and includes an enlarged head extended therefrom, for engaging with said partition, and for rotatably anchoring said follower to said partition, and for preventing said follower from sliding relative to said partition.

3. A holder device for attaching to a water outlet tube which is typically extended from a wall and coupled to a water reservoir, said holder device comprising:

a housing including an inlet for attaching to the water outlet tube, and for receiving water from the water reservoir, said housing including a first outlet port and at least one second outlet port, and including a casing received therein and having a chamber formed in said casing and communicating with said inlet and said first outlet port and said at least one second outlet port of said housing, said housing including two valve seats formed in said casing and communicating with said first outlet port and said at least one second outlet port of said housing respectively, and means for controlling the water to flow out through said first outlet port and said at least one second outlet port, said controlling means including a valve stem rotatably attached in said chamber of said casing, and having a passage formed therein, for communicating said inlet of said housing with said first outlet port and said at least one second outlet port of said housing, to allow the water to selectively flow out through said first outlet port and said at least one second outlet port of said housing, and said valve stem including a compartment formed therein, and a spring-biased valve member received in said compartment of said valve stem, to engage with either of said valve seats of said housing, and to control the water to flow out through said first outlet port and said at least one second outlet port of said housing.

4. The holder device as claimed in claim 1 further comprising a shower head attached to said first outlet port of said housing.

5. The holder device as claimed in claim 1 further comprising a sprayer nozzle attached to said at least one second outlet port of said housing.

6. The holder device as claimed in claim 5, wherein said housing includes an attaching device attached thereto, for attaching said sprayer nozzle thereto.

7. The holder device as claimed in claim 6, wherein said attaching device includes an opening formed therein for attaching said sprayer nozzle.

8. The holder device as claimed in claim 6, wherein said housing includes a partition secured thereto, said attaching device is rotatably attached to said partition.

9. The holder device as claimed in claim 1 further comprising a knob secured to said valve stem, to rotate said valve stem relative to said casing and said housing.

10. A holder device for attaching to a water outlet tube which is typically extended from a wall and coupled to a water reservoir, said holder device comprising:

a housing including an inlet for attaching to the water outlet tube, and for receiving water from the water reservoir, said housing including a first outlet port and at least one second outlet port, and including a casing received therein and having a chamber formed in said casing and communicating with said inlet and said first outlet port and said at least one second outlet port of said housing, means for controlling the water to flow out through said first outlet port and said at least one second outlet port, said controlling means including a valve stem rotatably attached in said chamber of said casing, and having a passage formed therein, for communicating said inlet of said housing with said first outlet port and said at least one second outlet port of said housing, to allow the water to selectively flow out through said first outlet port and said at least one second outlet port of said housing, and a knob secured to said valve stem to rotate said valve stem relative to said casing and said housing, and said housing including a spring-biased projection disposed therein, and engageable with said knob, to position said knob to said housing at selected position.

11. A holder device for attaching to a water outlet tube which is typically extended from a wall and coupled to a water reservoir, said holder device comprising:

a housing including an inlet for attaching to the water outlet tube, and for receiving water from the water reservoir, said housing including a first outlet port and at least one second outlet port, and including a casing received therein and having a chamber formed in said casing and communicating with said inlet and said first outlet port and said at least one second outlet port of said housing, means for controlling the water to flow out through said first outlet port and said at least one second outlet port, said controlling means including a valve stem rotatably attached in said chamber of said casing, and having a passage formed therein, for communicating said inlet of said housing with said first outlet port and said at least one second outlet port of said housing, to allow the water to selectively flow out through said first outlet port and said at least one second outlet port of said housing, and a knob secured to said valve stem to rotate said valve stem relative to said casing and said housing, and said knob including a barrel extended therefrom and attached to said valve stem, and at least one rib extended therein and coupled to said barrel, for reinforcing said barrel.

* * * * *